US007059237B2

(12) United States Patent
Ioku et al.

(10) Patent No.: US 7,059,237 B2
(45) Date of Patent: Jun. 13, 2006

(54) MULTIPLE-DIRECTIONAL SWITCHING VALVE

(75) Inventors: Kensuke Ioku, Hyogo-Ken (JP); Jun Nakano, Hyogo-Ken (JP)

(73) Assignee: NABCO Limited, Kobe (JP)

( * ) Notice: Subject to any disclaimer, the term of this patent is extended or adjusted under 35 U.S.C. 154(b) by 66 days.

(21) Appl. No.: 10/847,359

(22) Filed: May 18, 2004

(65) Prior Publication Data

US 2004/0231505 A1 Nov. 25, 2004

(30) Foreign Application Priority Data

May 19, 2003 (JP) ..... 2003-139744

(51) Int. Cl.
*F15B 13/00* (2006.01)

(52) U.S. Cl. ..... 91/515; 414/700

(58) Field of Classification Search ..... 91/515; 414/700; 60/424

See application file for complete search history.

(56) References Cited

U.S. PATENT DOCUMENTS 3,563,137 A * 2/1971 Graber et al. ..... 414/700
4,408,518 A 10/1983 Diel et al.
5,447,094 A 9/1995 Geyler, Jr.
5,669,282 A * 9/1997 Tanino et al. ..... 414/700
5,797,310 A 8/1998 Casey et al.
6,389,953 B1 * 5/2002 Altman et al. ..... 91/515

FOREIGN PATENT DOCUMENTS

JP 02-096028 4/1990
JP 07-252857 10/1995

* cited by examiner

*Primary Examiner*—Edward K. Look
*Assistant Examiner*—Michael Leslie
(74) *Attorney, Agent, or Firm*—Nixon Peabody LLP; Donald R. Studebaker

(57) ABSTRACT

In a multiple-switching valve having a bucket-leveling function, there are provided a diverged passage, which is diverged from a merged passage and connects with an unloading passage or a tank passage, and a switching valve to disconnect and connect the diverged passage. The switching valve allows a pressured oil drained from a rod-side chamber of a boom cylinder via a directional switching valve for boom to be supplied to the merged passage flow in the diverged passage, thereby preventing the pressure oil from being supplied to a head-side chamber of the bucket cylinder. Accordingly, the bucket-leveling function can be cancelled properly, thereby improving the operation of the multiple-directional switching valve.

4 Claims, 5 Drawing Sheets

MULTIPLE-DIRECTIONAL SWITCHING VALVE

BACKGROUND OF THE INVENTION

The present invention relates to a multiple-directional switching valve which has a bucket-leveling function in which a bucket is maintained at a level position by supplying a return pressured oil drained from a boom cylinder to a bucket cylinder when a boom is operated by supplying the pressured oil to the boom cylinder.

Conventionally, a multiple-directional switching valve which is used for a construction vehicle and the like and has a bucket-leveling function in which a bucket is maintained at a level position by supplying a return pressured oil drained from a boom cylinder to a bucket cylinder when a boom is operated by supplying the pressured oil to the boom cylinder. See, for example, Japanese Patent Laid-Open Publication No. 7-252857 (page 5, FIGS. 4 and 5), and Japanese Patent Laid-Open Publication No. 10-219730 (pages 4 and 5, FIGS. 1 through 3) (its corresponding U.S. Pat. No. 5,797,310). A hydraulic circuit disclosed in the former patent publication shows a multiple-directional switching valve having such bucket-leveling function in which the bucket is maintained in a position with a specified angle with respect to a ground surface by supplying a pressured oil drained from a second chamber (rod-side chamber) of a second cylinder (boom cylinder) to a first chamber (head-side chamber) of a first cylinder (bucket cylinder) when a lift arm (boom) is raised and by supplying a pressured oil drained from a first chamber of the second cylinder to a second chamber of the first cylinder when the lift arm is lowered. Further, an automatic-leveling control hydraulic device disclosed in the latter patent publication shows a multiple-directional switching valve having such bucket-leveling function as well.

Herein, the above-described hydraulic circuit of the former patent publication does not have a canceling function to cancel the bucket-leveling function properly. Accordingly, in the event that the boom is lowered and the bucket is dumped during, for example, a boring, there was a concern that a dumping speed of the bucket may be delayed compared with an operation expected by an operator or a dumping operation may not be performed properly because a bucket-leveling mechanism moves the bucket toward curing direction. Namely, the above-described hydraulic circuit of the former patent publication had a problem that its operation may deteriorate when both the boom and the bucket are operated at the same time.

Meanwhile, the above-described latter patent publication discloses an example of a means for canceling the bucket-leveling function in which a check valve is changed to a solenoid valve in which the solenoid valve is operated to allow a return oil from the boom cylinder to flow into a tank via the solenoid valve when the bucket-leveling function is required. However, there was a concern that since the return oil drained from the boom cylinder flows into the tank via a valve, a flow passage may be narrowed by the valve and there may occur some pressure here, so that the oil may flow into the bucket cylinder. As a result, there was a problem that such cancellation of the bucket-leveling function could not be provided properly.

Also, in the above-described hydraulic circuit of the former patent publication, a directional switching valve for boom, a flow divider system and a directional switching valve for bucket are located on an identical plane. Accordingly, there was a problem that the multiple-directional switching valve may require a relatively long shape in its longitudinal direction and thereby it may be difficult to provide an enough space for its disposition.

Herein, there are also other prior art disclosing similar multiple-directional switching valve, such as Japanese Patent Laid-Open Publication No. 2-96028, U.S. Pat. Nos. 4,408,518 and 5,447,094.

SUMMARY OF THE INVENTION

The present invention has been devised in view of the above-described problems, and an object of the present invention is to provide a multiple-directional switching valve having a bucket-leveling function which can cancel the bucket-leveling function properly, have an excellent operation and a relatively short shape in its longitudinal direction.

The above-described object can be solved by the following present invention.

According to the present invention of claim 1, there is provided a multiple-directional switching valve, including a pump port connecting with an oil pressure source, an unloading passage connecting with the pump port, a tank port connecting with a tank, a tank passage connecting with the tank port, a directional switching valve for boom connecting with the unloading passage and operative to control a supply of a pressured oil from the pump port to a boom cylinder, a directional switching valve for bucket connecting with the unloading passage and operative to control a supply of a pressured oil from the pump port to a bucket cylinder, and a merged passage operative to supply a part or a whole part of a return pressured oil which is drained from a rod-side chamber of the boom cylinder via the directional switching valve for boom to a head-side chamber of the bucket cylinder, and having a bucket-leveling function in which a bucket is maintained at a level position by supplying the return pressured oil drained from the rod-side chamber of the boom cylinder to the head-side chamber of the bucket cylinder when a boom is raised by supplying the pressured oil to a head-side chamber of the boom cylinder and the directional switching valve for boom is configured so as to disconnect the boom cylinder with the merged passage in a neutral position thereof, the multiple-directional switching valve comprising a diverged passage which is diverged from the merged passage and connects with the unloading passage or said tank passage, a switching valve operative to connect and disconnect the diverged passage, wherein the switching valve is switched to a connecting position thereof such that the return pressured oil which is drained from the rod-side chamber of the boom cylinder via the directional switching valve for boom to be supplied to the merged passage flows in the diverged passage and is prevented from being supplied to the head-side chamber of the bucket cylinder.

According to the above-described multiple-directional switching valve, since the pressured oil is returned to the unloading passage or the tank passage via the diverged passage diverged from the merged passage, it can be suppressed for some pressure to occur in the diverged passage. Further, the switching valve disposed in the diverged passage can block the oil flow from the rod-side chamber of the boom cylinder to the head-side chamber of the bucket cylinder, thereby canceling the bucket-leveling function properly.

According to the present invention of claim 2, there is provided a multiple-directional switching valve, including a pump port connecting with an oil pressure source, an unloading passage connecting with the pump port, a tank port connecting with a tank, a tank passage connecting with the tank port, a directional switching valve for boom connecting with the unloading passage and operative to control a supply of a pressured oil from the pump port to a boom cylinder, a directional switching valve for bucket connecting with the unloading passage and operative to control a supply of a pressured oil from the pump port to a bucket cylinder, and a second merged passage operative to supply a part or a whole part of a return pressured oil which is drained from a head-side chamber of the boom cylinder via the directional switching valve for boom to a rod-side chamber of the bucket cylinder, and having a bucket-leveling function in which a bucket is maintained at a level position by supplying the return pressured oil drained from the head-side chamber of the boom cylinder to the rod-side chamber of the bucket cylinder when a boom is lowered by supplying the pressured oil to a rod-side chamber of the boom cylinder and the directional switching valve for boom is configured so as to disconnect the boom cylinder with the second merged passage in a neutral position thereof, the multiple-directional switching valve comprising a second diverged passage which is diverged from the second merged passage and connects with the unloading passage or the tank passage, a second switching valve operative to connect and disconnect the diverged passage, wherein the second switching valve is switched to a connecting position thereof such that the return pressured oil which is drained from the head-side chamber of the boom cylinder via the directional switching valve for boom to be supplied to the second merged passage flows in the second diverged passage and is prevented from being supplied to the rod-side chamber of the bucket cylinder.

According to the above-described multiple-directional switching valve, since the pressured oil is returned to the unloading passage or the tank passage via the second diverged passage diverged from the second merged passage, it can be suppressed for some pressure to occur in the second diverged passage. Further, the switching valve disposed in the diverged passage can block the oil flow from the rod-side chamber of the boom cylinder to the head-side chamber of the bucket cylinder, thereby canceling the bucket-leveling function properly.

According to the present invention of claim 3, there is provided a multiple-directional switching valve, including a pump port connecting with an oil pressure source, an unloading passage connecting with the pump port, a tank port connecting with a tank, a tank passage connecting with the tank port, a directional switching valve for boom connecting with the unloading passage and operative to control a supply of a pressured oil from the pump port to a boom cylinder, a directional switching valve for bucket connecting with the unloading passage and operative to control a supply of a pressured oil from the pump port to a bucket cylinder, and a merged passage operative to supply a part or a whole part of a return pressured oil which is drained from a rod-side chamber of the boom cylinder via the directional switching valve for boom to a head-side chamber of the bucket cylinder, and having a bucket-leveling function in which a bucket is maintained at a level position by supplying the return pressured oil drained from the rod-side chamber of the boom cylinder to the head-side chamber of the bucket cylinder when a boom is raised by supplying the pressured oil to a head-side chamber of the boom cylinder and the directional switching valve for boom is configured so as to disconnect the boom cylinder with the merged passage in a neutral position thereof and have a float position to allow said head-side chamber and rod-side chamber of the boom cylinder to connect with said tank passage, wherein the directional switching valve for boom is configured so as to disconnect the head-side chamber of the boom cylinder with the merged passage in the float position thereof.

According to the above-described multiple-directional switching valve, when the bucket dumping is required in a state where the bucket is placed on the ground surface, the bucket can be dumped smoothly during raising the boom by switching the directional switching valve for boom to its float position because the pressured oil is not supplied from the head-side chamber of the boom cylinder to the rod-side chamber of the bucket cylinder. Herein, in the case where the flow dividing valve of the above-described latter patent publication is applied to a series circuit to perform the same operation as the above, there was a concern that an unstable operation may occur because the oil is supplied from the head-side chamber of the boom cylinder to the rod-side chamber of the bucket cylinder and the oil is drained from a relief valve (unloading valve 47) during the operation. According to the present invention, however, such unstable operation can be avoided.

According to the present invention of claim 4, there is provided a multiple-directional switching valve, comprising a valve body which includes a pump port connecting with an oil pressure source, an unloading passage connecting with the pump port, a tank port connecting with a tank, a tank passage connecting with the tank port, a directional switching valve for boom connecting with the unloading passage and operative to control a supply of a pressured oil from the pump port to a boom cylinder, a directional switching valve for bucket connecting with the unloading passage and operative to control a supply of a pressured oil from the pump port to a bucket cylinder, and a merged passage operative to supply a part of a return pressured oil which is drained from a head-side chamber of the boom cylinder via the directional switching valve for boom to a rod-side chamber of the bucket cylinder, a bypass passage operative to supply the rest of the return pressured oil which is drained from the head-side chamber of the boom cylinder to said unloading passage or said tank passage, a flow divider system including an orifice for merged flow which is disposed in said merged passage and an orifice which is disposed in said bypass passage, a second merged passage operative to operative to supply a part of a return pressured oil which is drained from a rod-side chamber of the boom cylinder via the directional switching valve for boom to a head-side chamber of the bucket cylinder, a second bypass passage operative to supply the rest of the return pressured oil which is drained from the rod-side chamber of the boom cylinder to said unloading passage or said tank passage, a second flow divider system including a second orifice for merged flow which is disposed in said second merged passage and a second orifice which is disposed in said second bypass passage, and having a bucket-leveling function in which a bucket is maintained at a level position by supplying the return pressured oil drained from the rod-side chamber of the boom cylinder to the head-side chamber of the bucket cylinder when a boom is raised by supplying the pressured oil to the head-side chamber of the boom cylinder and supplying the return pressured oil drained from the head-side chamber of the boom cylinder to the rod-side chamber of the bucket cylinder when the boom is lowered by supplying the pressured oil to the rod-side chamber of the boom cylinder, wherein either of the orifice for merged flow and the orifice is configured of a variable orifice, either of the second orifice for merged flow and the second orifice is configured of a variable orifice, the directional switching valve for boom and the directional switching valve for bucket are located on a first plane, and the directional switching valve for boom and the both variable orifices are located on a second plane which is perpendicular to the first plane.

According to the above-described multiple-directional switching valve, since the variable orifices are located in parallel to the rotational switching valve for boom and the rotational switching valve for bucket, the length of the multiple-directional switching valve can be made short.

DETAILED DESCRIPTION OF THE INVENTION

Hereinafter, preferred embodiments of the present invention will be described with reference to the accompanying drawings.

Figure 1:
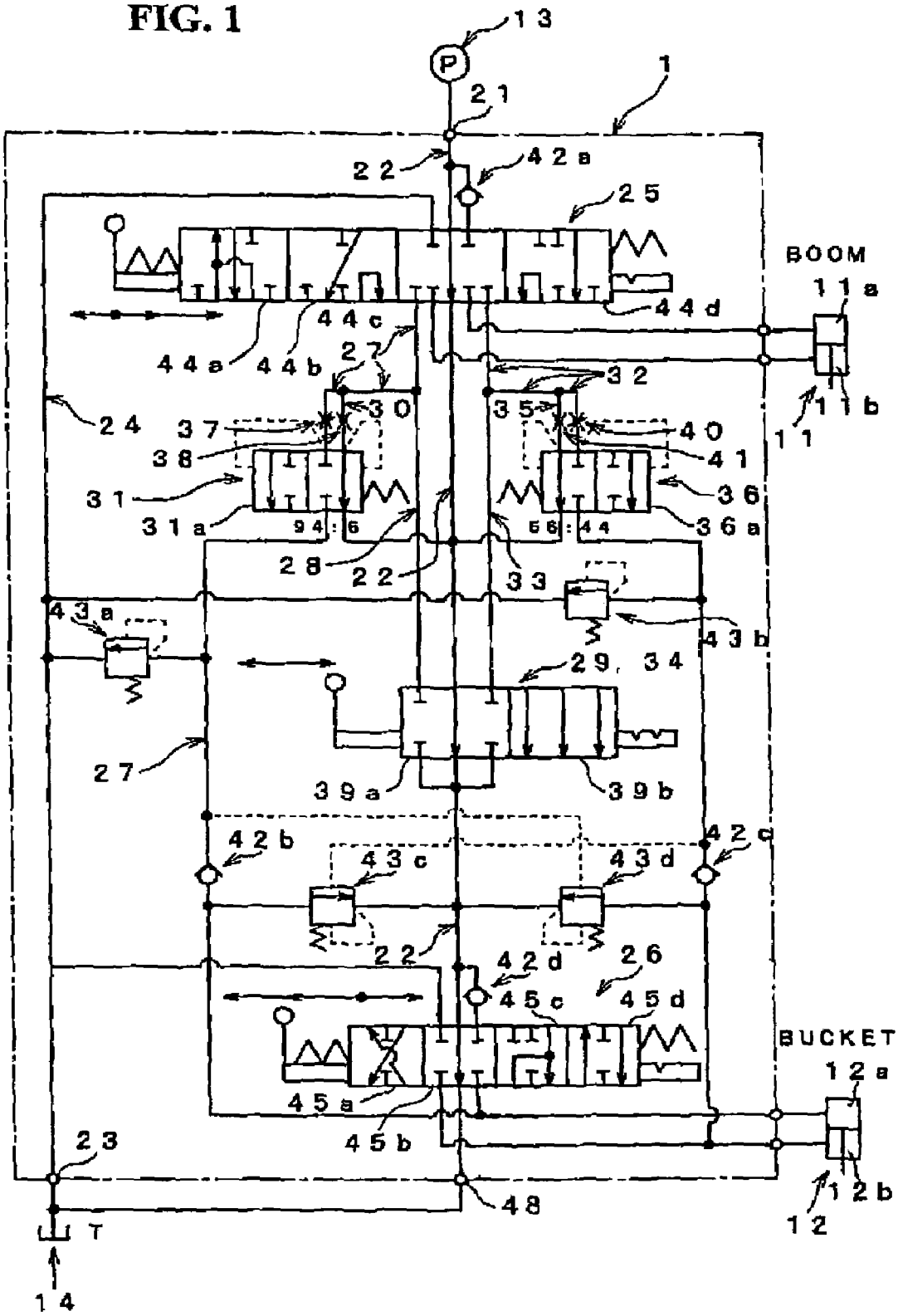
FIG. 1 is a diagram of an exemplified hydraulic circuit of a multiple-directional switching valve having a bucket-leveling function according to a preferred embodiment of the present invention.

FIG. 1 is a diagram of an exemplified hydraulic circuit of a multiple-directional switching valve having a bucket-leveling function (hereinafter, referred to as "multiple-directional switching valve 1") according to a preferred embodiment of the present invention. The multiple-directional switching valve 1 is used for a construction machine like a loader (not illustrated) which comprises oil-pressure operating devices, such as a boom (which is, for example, attached to a front of a loader so as to be raised and lowered) and a bucket (which is, for example, attached to a front end of the boom). The boom (not illustrated) is operated by a boom cylinder 11 in such a manner that it is raised by supplying a pressured oil to a head-side chamber 11*a*, while it is lowered by supplying a pressure oil to a rod-side chamber 11*b*. The bucket (not illustrated) is operated by a bucket cylinder 12 in such a manner that it is dumped by supplying a pressured oil to a head-side chamber 12*a*, while it is curled by supplying a pressure oil to a rod-side chamber 12*b*.

The multiple-directional switching valve 1, as shown in FIG. 1, connects with the boom cylinder 11, the bucket cylinder 12, a pump 13 and a tank 14, and it comprises a pump port 21, an unloading passage 22, a tank port 23, a tank passage 24, a directional switching valve for boom 25 and a directional switching valve for bucket 26. The pump port 21 connects with the pump 13 as an oil pressure source and the unloading passage 22. The tank port 23 connects with the tank 14 and the tank passage 24. Herein, a port 48 is provided most downstream of the unloading passage 22, and it connects with the tank 14.

The directional switching valve for boom 25 connects with the unloading passage 22 and controls a supply of pressured oil from the pump port 21 to the boom cylinder 11. The directional switching valve for bucket 26 also connects with the unloading passage 22 and controls a supply of pressured oil from the pump port 21 to the bucket cylinder 12. The directional switching valve for boom 25 and the directional switching valve for bucket 26 are connected with each other in series by the unloading passage 22.

Further, the multiple-directional switching valve 1 comprises a merged passage 27, a diverged passage 28, a switching valve 29, a bypass passage 30, a flow divider system 31, a second merged passage 32, a second diverged passage 33, a second switching valve 34, a second bypass passage 35, and a second flow divider system 36.

The merged passage 27 is configured so as to supply a part (or a whole part) of a return oil drained from the rod-side chamber 11*a* of the boom cylinder 11 to the head-side chamber 12*a* of the bucket cylinder 12 via the directional switching valve for boom 25. The bypass passage 30 is diverged from the merged passage 27 and is configured so as to allow the reset of return oil drained from the rod-side chamber 11*a* of the boom cylinder 11, which is not supplied to the head-side chamber 12*a* of the bucket cylinder 12, to flow in the unloading passage 22 (or the tank passage 24).

The flow divider system 31 divides the return oil drained from the rod-side chamber 11*b* of the boom cylinder 11 into a flow to the merged passage 27 and a flow to the bypass passage 30. The flow divider system 31 comprises an orifice for merged flow 37 which is disposed in the merged passage 27, an orifice 38 which is disposed in the bypass passage 30, and a flow dividing valve 31*a*. In the flow divider system 31, the flow dividing valve 31*a* adjusts a specified pressure difference between pressures downstream of the orifice for merged flow 37 and the orifice 38. Accordingly, the ratio of flow amount of flows between the merged passage 27 and the bypass passage 30 is maintained at a specified value (for example, 94:6). Either one of the orifice for merged flow 37 and the orifice 38 is configured of a variable orifice (the orifice 38 may be configured of a variable orifice, but the orifice for merged flow 37 may not).

The diverged passage 28 is diverged from the merged passage 27 at a location upstream of the bypass passage 30 and connects with the unloading passage 22 (or the tank passage 24). The switching valve 29 disconnects with the diverged passage 28 in its leveling-movement position 39*a*, while it connects with the diverged passage 28 in its leveling-cancellation position 39*b*.

The second merged passage 32 is configured so as to supply a part (or a whole part) of a return oil drained from the head-side chamber 11*a* of the boom cylinder 11 to the rod-side chamber 12*b* of the bucket cylinder 12 via the directional switching valve for boom 25. The second bypass passage 35 is diverged from the second merged passage 32 and is configured so as to allow the reset of returned oil from the head-side chamber 11*a* of the boom cylinder 11, which is not supplied to the rod-side chamber 12*b* of the bucket cylinder 12, to flow in the unloading passage 22 (or the tank passage 24).

The second flow divider system 36 divides the return oil drained from the head-side chamber 11*a* of the boom cylinder 11 into a flow to the second merged passage 32 and a flow to the second bypass passage 35. The second flow divider system 36 comprises a second orifice for merged flow 40 which is disposed in the second merged passage 32, a second orifice 41 which is disposed in the second bypass passage 35, and a second flow dividing valve 36*a*. In the second flow divider system 36, the second flow dividing valve 36*a* adjusts a specified pressure difference between pressures downstream of the second orifice for merged flow 40 and the second orifice 41. Accordingly, the ratio of flow amount of flows between the second merged passage 32 and the second bypass passage 35 is maintained at a specified value (for example, 56:44). Either one of the second orifice for merged flow 40 and the second orifice 41 is configured of a variable orifice (the second orifice 41 may be configured of a variable orifice, but the second orifice for merged flow 40 may not).

The second diverged passage 33 is diverged from the second merged passage 32 at a location upstream of the second bypass passage 35 and connects with the unloading passage 22 (or the tank passage 24). The second switching valve 34 is formed integrally with the switching valve 29 and disconnects with the second diverged passage 33 in its leveling-movement position 39*a*, while it connects with the second diverged passage 33 in its leveling-cancellation position 39*b*. Herein, there are provided check valves 42*a*–42*b*, relief valves 43*a*, 43*b* and unloading valves 43*c*, 44*d* at specified portions of the multiple-directional switching valve 1 so as to regulate flows in the hydraulic circuit respectively.

Next, the operation of the multiple-directional switching valve 1 will be described. The directional switching valve for boom 25 can take its four switching positions of a float position 44*a*, a lower position 44*b*, a neutral position 44*c* and a raise position 44*d*. In its neutral position 44*c*, it allows the unloading passage 22 to be connected, while it allows the merged passage 27 and the second merged passage 32 to be disconnected with the boom cylinder 11. In its raise position 44*d*, it allows the pressured oil from the pump 13 to be supplied to the head-side chamber 11*a* of the boom cylinder 11, and it allows the rod-side chamber 11*b* to connect with the merged passage 27. Accordingly, when the boom is raised by supplying the pressured oil to the head-side chamber 12*a* of the boom cylinder 11, the return pressured oil drained from the rod-side chamber 11*b* of the boom cylinder 11 is supplied to the head-side chamber 12*a* of the bucket cylinder 12, so that the bucket can be maintained at the level position.

The bucket-leveling function during the boom raising is performed when the diverged passage 28 is disconnected, i.e., the switching valve 29 is in its leveling-movement position 39*a*. Meanwhile, when the switching valve 29 is switched to its leveling-cancellation position 39*b*, the diverged passage 28 connects with the unloading passage 22. Accordingly, the pressured oil which is drained from the rod-side chamber 11*b* of the boom cylinder 11 via the directional switching valve for boom 25 to be supplied to the merged passage 27 flows in the diverged passage 28 and is prevented from being supplied to the head-side chamber 12*a* of the bucket cylinder 12. Namely, the bucket-leveling function is cancelled.

Accordingly, since the pressured oil is diverged from the merged passage 27 and returned to the unloading passage 22, it does not flow in the merged passage 27, thereby canceling the bucket-leveling function. Herein, although the diverged passage 28 is shown so as to be diverged from upstream of the flow divider system 31 in FIG. 1, it may be diverged downstream of it. Also, although the switching valve 29 is provided downstream of the diverged passage 28, it may be provided at the diverged position which is most upstream of the diverged passage 28. In this case, it may be switched to its leveling-cancellation position 39*b* and the merged passage 27 may be closed. Further, the pressure of the merged passage 27 can be maintained at a low pressure (equivalent to a pressure of the unloading passage 22) during the cancellation of the bucket-leveling function. Thus, it is not necessary to use the check valve 42*b* with a spring having a strong spring force in the merged passage 27, thereby reducing a pressure loss in the merged passage 27.

When the directional switching valve for boom 25 is switched to its lower position 44*b*, the pressured oil from the pump 13 is supplied to the rod-side chamber 11*b* of the boom cylinder 11 and the head-side chamber 11*a* is connected with the second merged passage 32. Accordingly, when the boom is lowered by supplying the pressured oil to the rod-side chamber 11*b* of the boom cylinder 11, the return pressured oil drained from the head-side chamber 11*a* of the boom cylinder 11 is supplied to the rod-side chamber 12*b* of the bucket cylinder 12, thereby maintaining the bucket at the level position.

The bucket-leveling function during the boom lowering is performed when the second diverged passage 33 is disconnected, i.e., the second switching valve 34 is in its leveling-movement position 39*a*. Meanwhile, when the second switching valve 34 is switched to its leveling-cancellation position 39*b*, the second diverged passage 33 connects with the unloading passage 22. Accordingly, the pressured oil which is drained from the head-side chamber 11*a* of the boom cylinder 11 via the directional switching valve for boom 25 to be supplied to the second merged passage 33 flows in the second diverged passage 33 and is prevented from being supplied to the rod-side chamber 12*b* of the bucket cylinder 12. Namely, the bucket-leveling function is cancelled.

Accordingly, since the pressured oil is diverged from the second merged passage 32 and returned to the unloading passage 22, it does not flow in the second merged passage 32, thereby canceling the bucket-leveling function. Herein, although the second diverged passage 33 is shown so as to be diverged from upstream of the second flow divider system 36 in FIG. 1, it may be diverged from downstream of it. Also, although the second switching valve 34 is provided downstream of the second diverged passage 33, it may be provided at the diverged position which is most upstream of the second diverged passage 33. In this case, it may be switched to its leveling-cancellation position 39*b* and the second merged passage 32 may be closed. Further, since the weight of the boom itself acts during the boom lowering, a meter-out control in which the return pressured oil drained from the head-side chamber 11*a* of the boom cylinder 11 is restricted may be executed. In this case, the second merged passage 32 is connected via the directional switching valve for boom 25, there hardly occurs some pressure in the second merged passage 32, thereby canceling the bucket-leveling function properly.

When the directional switching valve for boom 25 is switched to its float position 44*a*, the unloading passage 22 is connected and the head-side chamber 11*a* and the rod-side chamber 11*b* of the boom cylinder 11 are connected with the tank passage 24, while the head-side chamber 11*a* of the boom cylinder 11 is disconnected with the merged passage 27. Accordingly, when the bucket dumping is required in a state where the bucket is placed on the ground surface, the bucket can be dumped smoothly during raising the boom by switching the directional switching valve for boom 25 to its float position 44*a* because the pressured oil is not supplied from the head-side chamber 11*a* of the boom cylinder 11 to the rod-side chamber 12*b* of the bucket cylinder 12. Thus, works such as ground leveling where the boom is raised slightly and the bucket dumping movement is repeated can be done easily.

Next, the directional switching valve for bucket 26 can take its four switching positions of a curl position 45*a*, a neutral position 45*b*, a high-dump position 45*c* and a dump position 45*d*. In its curl position 45*a*, it allows the rod-side chamber 12*b* of the bucket cylinder 12 to connect with the pump 13 and allows the head-side chamber 12*a* to connect with the tank passage 24, thereby curling the bucket. In its neutral position 45*b*, it allows only the unloading passage 22 to be connected. In its high-dump position 45*c*, it allows the head-side chamber 12*a* and the rod-side chamber 12*b* to connect with the pump 13. In its dump position 45*d*, it allows the head-side chamber 12*a* to connect the pump 13 and allows the rod-side chamber 12*b* to connect with the tank passage 24, thereby dumping the bucket.

Figure 2:
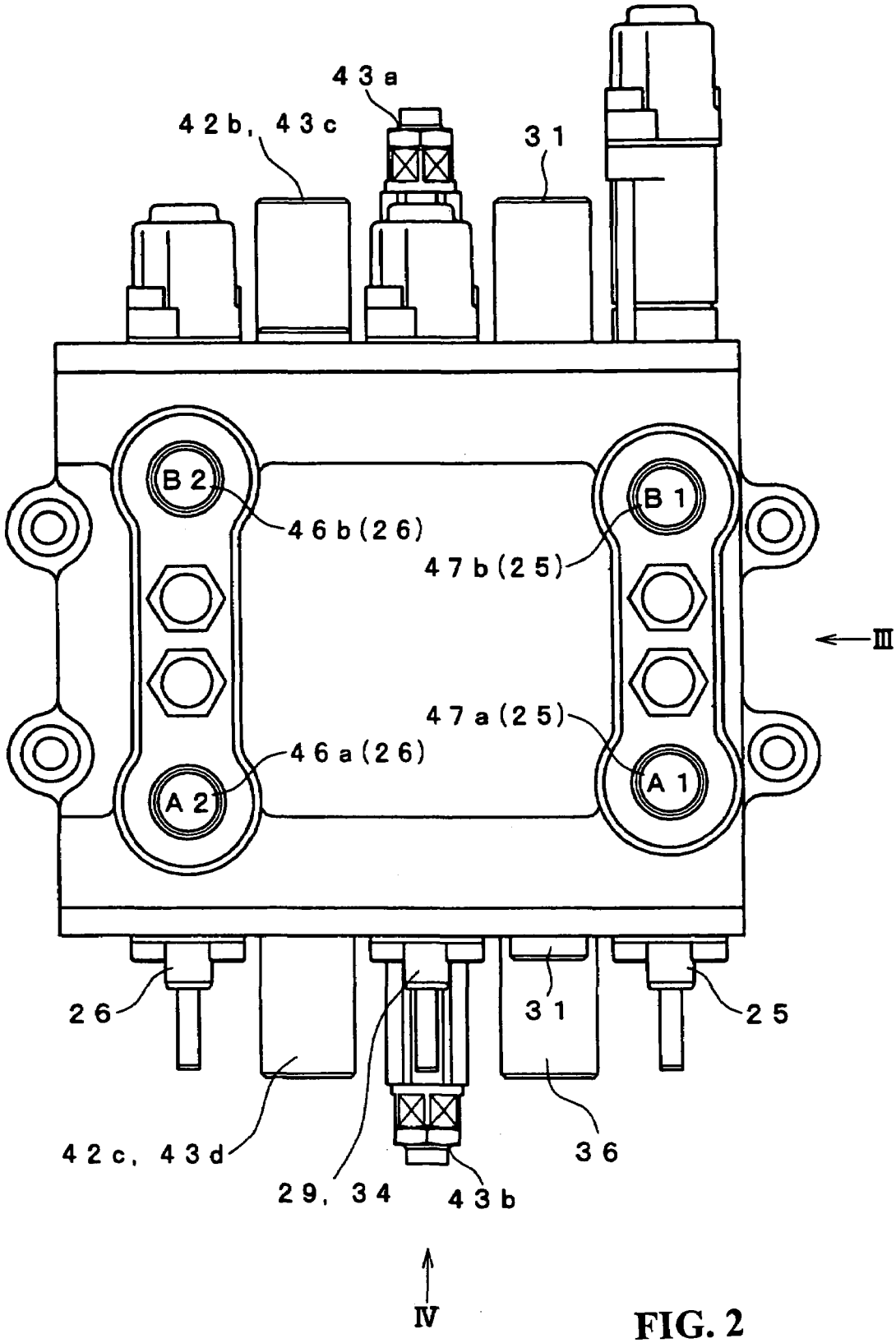
FIG. 2 is plan view of the multiple-directional switching valve shown in FIG. 1.

Next, the shape of the multiple-directional switching valve 1 will be described. As shown in a plan view of FIG. 2, the multiple-directional switching valve 1 is formed in a substantially boxy shape, and respective ports (46*a*, 46*b*) of the directional switching valve for bucket 26 and respective ports (47*a*, 47*b*) of the directional switching valve for boom 25 are located at a side of its upper face. Also, respective end portions of the directional switching valve for boom 25, the directional switching valve for bucket 26, and other valves (42*c*, 43*d*, 29, 34, 31, 36 and so on) protrude from its side face denoted by an arrow IV. As shown in FIG. 2, the directional switching valve for boom 25 and the directional switching valve for bucket 26 are disposed in parallel to each other on an identical plane. Also, as shown in a side view of FIG. 3 when viewed along an arrow III of FIG. 2, two variable orifices (the orifice for merged flow 37 and the second orifice for merged flow 40) are disposed coaxially. Herein, the pump port 21 opens on the side face denoted by the arrow III.

Figure 3:
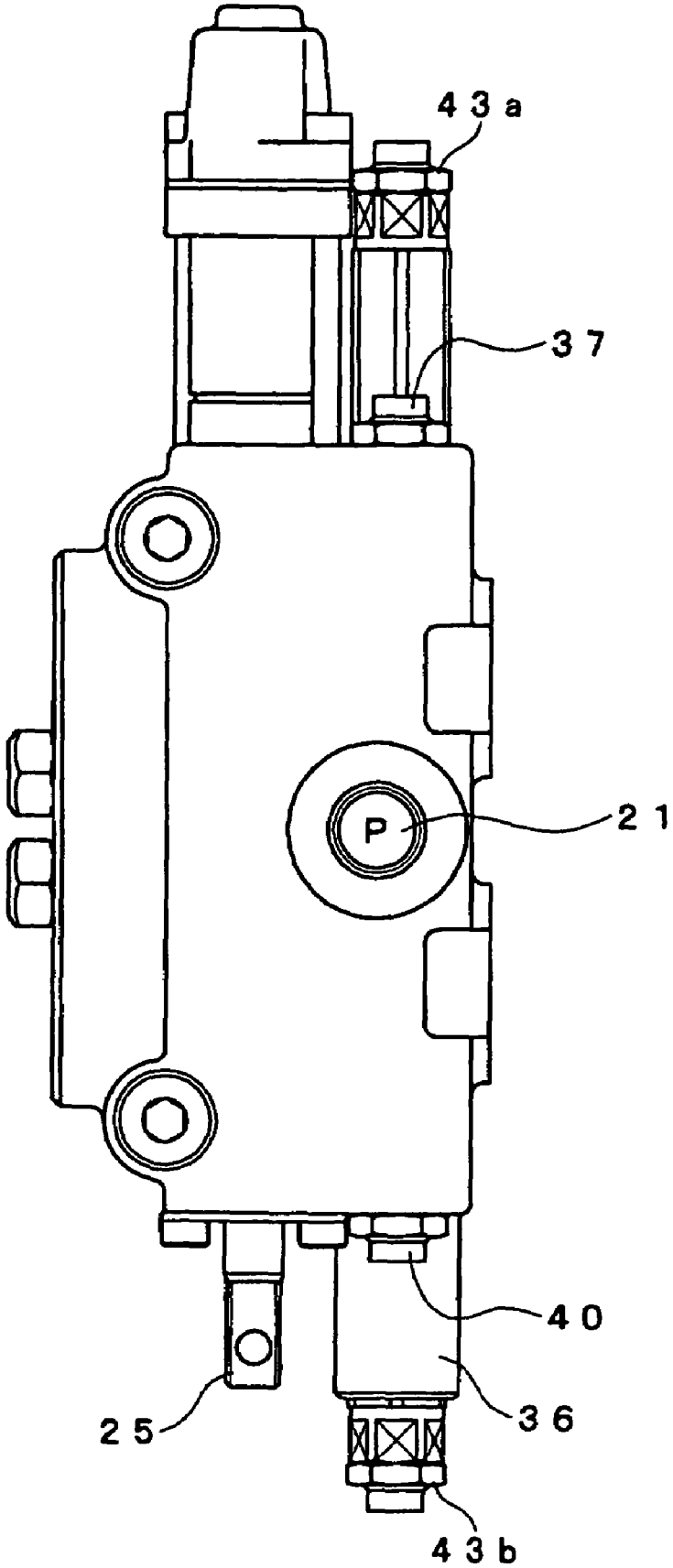
FIG. 3 is a side view of the multiple-directional switching valve, when viewed along an arrow III of FIG. 2.
Figure 4:
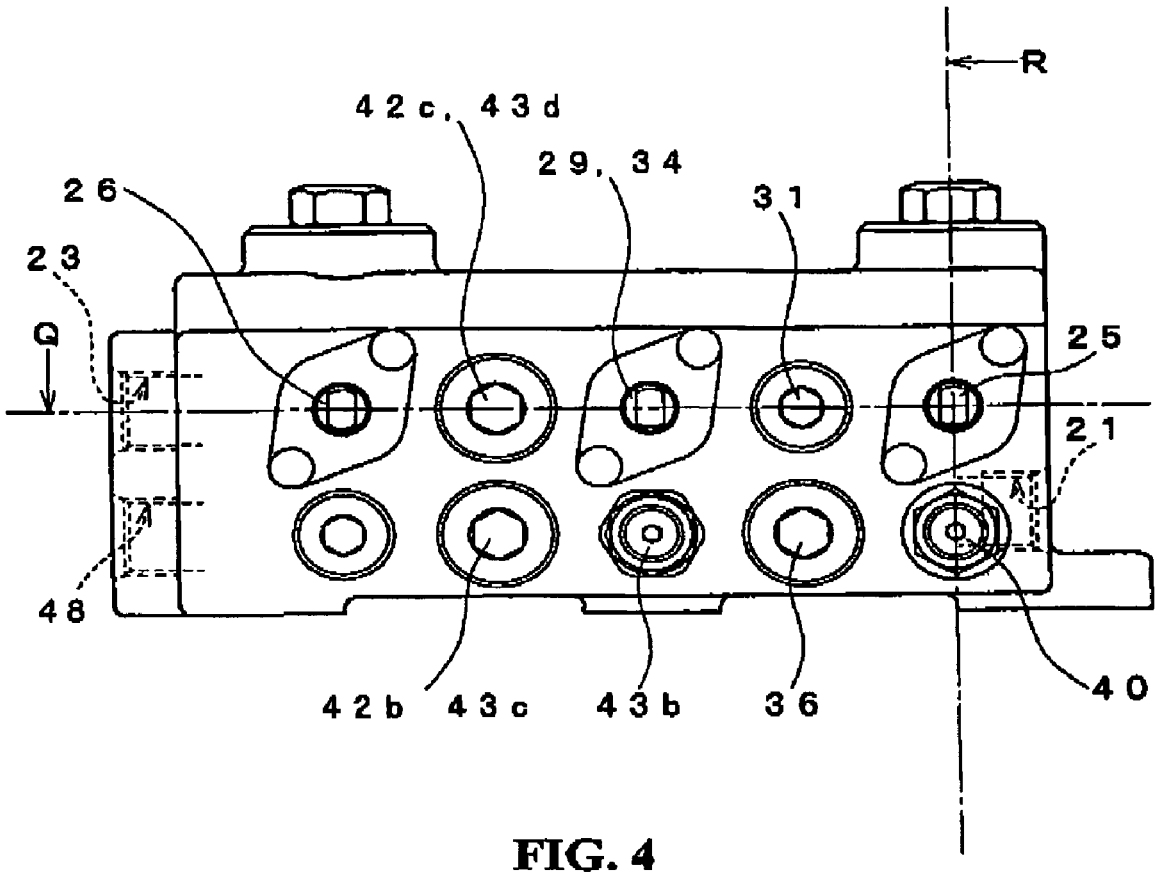
FIG. 4 is a side view of the multiple-directional switching valve, when viewed along an arrow IV of FIG. 2.

FIG. 4 is a side view when viewed along the arrow IV, and end portions of respective valves (26, 42*c*, 43*d*, 42*b*, 43*c*, 29, 34, 31, 36, 25, 40 and so on) protrude from this side face denoted by the arrow IV. One dash-dotted lines Q and R denote respectively both planes (first plane Q and second plane R) which are vertical to a surface of the drawing sheet, and the first and second planes Q, R are perpendicular to each other. As shown in FIGS. 2–4, the directional switching valve for boom 25 and the directional switching valve for bucket 26 are disposed on the first plane Q, and the directional switching valve for boom 25 and the variable orifices 37, 40 are disposed on the second plane R which is perpendicular to the first plane Q. Accordingly, in the multiple-directional switching valve 1 having a bucket-leveling function, since the variable orifices 37, 40 are located in parallel to the rotational switching valve for boom 25 and the rotational switching valve for bucket 26, the length of the multiple-directional switching valve 1 can be made short.

Further, in order to further its compactness, it is preferred that the flow divider system 31 and the second flow divider system 36 are disposed between the rotational switching valve for boom 25 and the rotational switching valve for bucket 26. Further, it is more preferred that the flow divider system 31 and the second flow divider system 36 are disposed between the rotational switching valve for boom 25 and the rotational switching valve for bucket 26 and in parallel on the identical plane. It is preferred that the switching valve 29 and the second switching valve 34 are disposed between the rotational switching valve for boom 25 and the rotational switching valve for bucket 26. It is preferred that the switching valve 29, the second switching valve 34 and relief valves 43*a*, 43*b* are disposed in parallel to each other on the identical plane. It is preferred that the relief valves 43*a*, 43*b* are disposed coaxially. It is preferred that the check valve 42*b* and the unloading valve 43*c* are disposed coaxially. It is preferred that the check valve 42*c* and the unloading valve 43*d* are disposed coaxially. It is preferred that the check valve 42*b* and the unloading valve 43*c*, and the check valve 42*c* and the unloading valve 43*d* are disposed in parallel on the identical plane.

Although preferred embodiments are described above, the present invention should not limited to these embodiments. Any modifications can be adopted within the scope of the claimed invention. For example, the following modifications may be possible.

Figure 5:
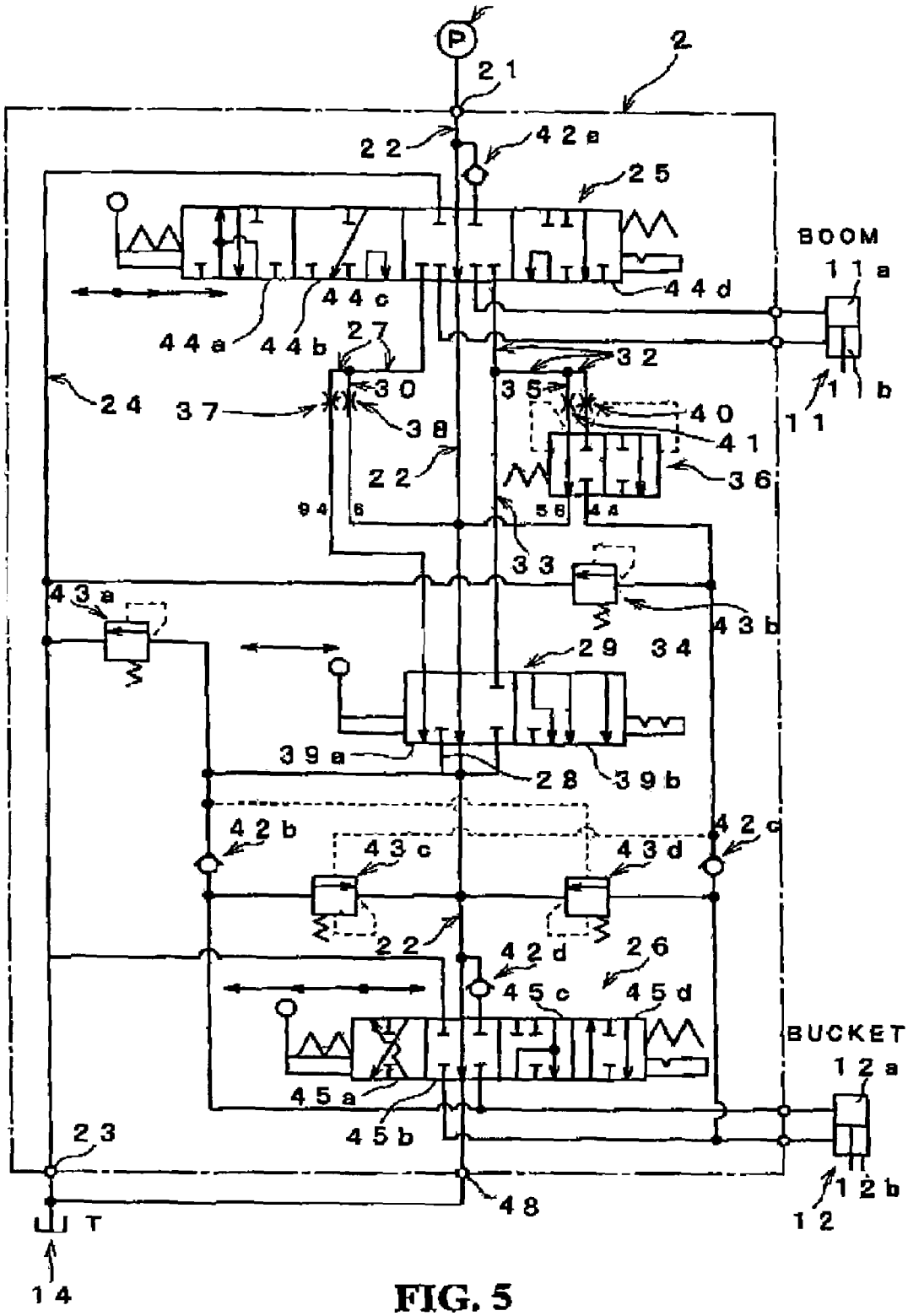
FIG. 5 is a diagram of a hydraulic circuit of a multiple-directional switching valve having a bucket-leveling function according to a modified embodiment.

FIG. 5 is a diagram of a hydraulic circuit of a multiple-directional switching valve 2 according to a modified embodiment. The same parts as the multiple-directional switching valve 1 of FIG. 1 are denoted by the same reference numerals. However, the multiple-directional switching valve 2 is different from the multiple-directional switching valve 1 in the following three points: it has no flow dividing valve 31*a*; its diverged passage 28 is connected with downstream of the flow divider system 31; and it has a different structure of the switching valve 29 (second switching valve 34). In the multiple-directional switching valve 2, the switching valve 29 (second switching valve 34) in its leveling-movement position 39*a* allows the merged passage 27 to connect with the head-side chamber 12*a* of the bucket cylinder 12 and allows the second diverged passage 33 to be disconnected. While, the switching valve 29 in its leveling-cancellation position 39*b* allows the merged passage 27 to connect with the unloading passage 22 via the diverged passage 28 and allows the second diverged passage 33 to connect with the unloading passage 22. As described above, the multiple-directional switching valve 2 can also maintain the bucket at its level position during the both boom raising and boom lowering like the multiple-directional switching valve 1. Further, it can cancel the bucket-leveling function properly during the boom raising by switching the switching valve 29 to its leveling-cancellation position 39*b* so as to return the pressured oil from the merged passage 27 to the unloading passage directly and disconnect the passage leading to the switching valve for bucket 26. Herein, the cancellation of the bucket-leveling function during the boom lowering is the same as that in the multiple-directional switching valve 1.

(2) An exchanged circuit constitution for the boom raising and the boom lowering unlike the multiple-directional switching valve 2 of FIG. 5 may be used. Namely, the following circuit can be applied: the flow divider system 31 is provided but the flow divider 36 is not provided; the diverged passage 28 is provided but the second diverged passage 33 is not provided; in its leveling-movement position 39*a*, the diverged passage 28 is disconnected but the second merged passage 32 is connected with the head-side chamber 12*a* of the bucket cylinder 12; and in its leveling-cancellation position 39*b*, the diverged passage 28 and the second merged passage 32 are connected with the unloading passage 22.

(3) Other modifications may be used in which the bucket-leveling function is performed only during the boom raising or only during the boom lowering. Also, the valve with no its float position may be adopted.

What is claimed is:

1. A multiple-directional switching valve, including a pump port connecting with an oil pressure source, an unloading passage connecting with the pump port, a tank port connecting with a tank, a tank passage connecting with the tank port, a directional switching valve for boom connecting with the unloading passage and operative to control a supply of a pressured oil from the pump port to a boom cylinder, a directional switching valve for bucket connecting with the unloading passage and operative to control a supply of a pressured oil from the pump port to a bucket cylinder, a merged passage operative to supply a part or a whole part of a return pressured oil which is drained from a rod-side chamber of the boom cylinder via the directional switching valve for boom to a head-side chamber of the bucket cylinder, and a flow divider system operative to divide the return oil drained from the rod-side chamber of the boom cylinder into a flow to the merged passage and a flow to the unloading passage, and having a bucket-leveling function in which a bucket is maintained at a level position by supplying the return pressured oil drained from the rod-side chamber of the boom cylinder to the head-side chamber of the bucket cylinder when a boom is raised by supplying the pressured oil to the head-side chamber of the boom cylinder and the directional switching valve for boom is configured so as to disconnect the boom cylinder with the merged passage in a neutral position thereof, the multiple-directional switching valve comprising:

a diverged passage which is diverged from said merged passage at a location upstream of said flow divider system and connects with said unloading passage or said tank passage;

a switching valve operative to connect and disconnect said diverged passage, the switching valve being provided so as to connect and disconnect the diverged passage independently from operation of said directional switching valve for a boom, wherein said switching valve is switched to a connecting position thereof such that said return pressured oil which is drained from the rod-side chamber of the boom cylinder via the directional switching valve for the boom to be supplied to said merged passage flows in said diverged passage and is prevented from being supplied to said head-side chamber of the bucket cylinder.

2. A multiple-directional switching valve, including a pump port connecting with an oil pressure source, an unloading passage connecting with the pump port, a tank port connecting with a tank, a tank passage connecting with the tank port, a directional switching valve for boom connecting with the unloading passage and operative to control a supply of a pressured oil from the pump port to a boom cylinder, a directional switching valve for bucket connecting with the unloading passage and operative to control a supply of a pressured oil from the pump port to a bucket cylinder, a second merged passage operative to supply a part or a whole part of a return pressured oil which is drained from a head-side chamber of the boom cylinder via the directional switching valve for boom to a rod-side chamber of the bucket cylinder, and a second flow divider system operative to divide the return oil drained from the head-side chamber of the boom cylinder into a flow to the second merged passage and a flow to the unloading passage, and having a bucket-leveling function in which a bucket is maintained at a level position by supplying the return pressured oil drained from the head-side chamber of the boom cylinder to the rod-side chamber of the bucket cylinder when a boom is lowered by supplying the pressured oil to the rod-side chamber of the boom cylinder and the directional switching valve for boom is configured so as to disconnect the boom cylinder with the second merged passage in a neutral position thereof, the multiple-directional switching valve comprising:

a second diverged passage which is diverged from said second merged passage at a location upstream of said second flow divider system and connects with said unloading passage or said tank passage;

a second switching valve operative to connect and disconnect said second diverged passage, the second switching valve being provided so as to connect and disconnect the second diverged passage independently from operation of said directional switching valve for boom, wherein said second switching valve is switched to a connecting position thereof such that said return pressured oil which is drained from the head-side chamber of the boom cylinder via the directional switching valve for boom to be supplied to said second merged passage flows in said second diverged passage and is prevented from being supplied to said rod-side chamber of the bucket cylinder.

3. A multiple-directional switching valve, including a pump port connecting with an oil pressure source, an unloading passage connecting with the pump port, a tank port connecting with a tank, a tank passage connecting with the tank port, a directional switching valve for boom connecting with the unloading passage and operative to control a supply of a pressured oil from the pump port to a boom cylinder, a directional switching valve for bucket connecting with the unloading passage and operative to control a supply of a pressured oil from the pump port to a bucket cylinder, and a merged passage operative to supply a part or a whole part of a return pressured oil which is drained from a rod-side chamber of the boom cylinder via the directional switching valve for boom to a head-side chamber of the bucket cylinder, and having a bucket-leveling function in which a bucket is maintained at a level position by supplying the return pressured oil drained from the rod-side chamber of the boom cylinder to the head-side chamber of the bucket cylinder when a boom is raised by supplying the pressured oil to the head-side chamber of the boom cylinder and the directional switching valve for boom is configured so as to disconnect the boom cylinder with the merged passage in a neutral position thereof and have a float position to allow said head-side chamber and rod-side chamber of the boom cylinder to connect with said tank passage, wherein said directional switching valve for boom is configured so as to disconnect said head-side chamber of the boom cylinder and said rod-side chamber of the boom cylinder with said merged passage in the float position thereof.

4. A multiple-directional switching valve, comprising a valve body which includes a pump port connecting with an oil pressure source, an unloading passage connecting with the pump port, a tank port connecting with a tank, a tank passage connecting with the tank port, a directional switching valve for boom connecting with the unloading passage and operative to control a supply of a pressured oil from the pump port to a boom cylinder, a directional switching valve for bucket connecting with the unloading passage and operative to control a supply of a pressured oil from the pump port to a bucket cylinder, and a merged passage operative to supply a part of a return pressured oil which is drained from a head-side chamber of the boom cylinder via the directional switching valve for boom to a rod-side chamber of the bucket cylinder, a bypass passage operative to supply the rest of the return pressured oil which is drained from the head-side chamber of the boom cylinder to the unloading passage or the tank passage, a flow divider system including an orifice for merged flow which is disposed in said merged passage and an orifice which is disposed in the bypass passage, a second merged passage operative to supply a part of a return pressured oil which is drained from a rod-side chamber of the boom cylinder via the directional switching valve for boom to a head-side chamber of the bucket cylinder, a second bypass passage operative to supply the rest of the return pressured oil which is drained from the rod-side chamber of the boom cylinder to the unloading passage or the tank passage, a second flow divider system including a second orifice for merged flow which is disposed in the second merged passage and a second orifice which is disposed in the second bypass passage, and having a bucket-leveling function in which a bucket is maintained at a level position by supplying the return pressured oil drained from the rod-side chamber of the boom cylinder to the head-side chamber of the bucket cylinder when a boom is raised by supplying the pressured oil to the head-side chamber of the boom cylinder and supplying the return pressured oil drained from the head-side chamber of the boom cylinder to the rod-side chamber of the bucket cylinder when the boom is lowered by supplying the pressured oil to the rod-side chamber of the boom cylinder, wherein either of said orifice for merged flow and said orifice is configured of a variable orifice, either of said second orifice for merged flow and said second orifice is configured of a variable orifice, said directional switching valve for boom and said directional switching valve for bucket are located on a first plane, said directional switching valve for boom and said both variable orifices are located on a second plane which is perpendicular to said first plane, and said flow divider system and said second flow divider system are disposed between the directional switching valve for boom and the directional switching valve for bucket on an identical plane which is perpendicular to said first plane.

* * * * *